US008474471B2

(12) United States Patent
Lenhart

(10) Patent No.: US 8,474,471 B2
(45) Date of Patent: Jul. 2, 2013

(54) STICK WITH A SHOCK ABSORBER

(75) Inventor: Klaus Lenhart, Ohmden (DE)

(73) Assignee: Lekisport AG, Baar (CH)

( * ) Notice: Subject to any disclaimer, the term of this patent is extended or adjusted under 35 U.S.C. 154(b) by 448 days.

(21) Appl. No.: 12/666,579

(22) PCT Filed: Jun. 24, 2008

(86) PCT No.: PCT/CH2008/000283

§ 371 (c)(1),
(2), (4) Date: Dec. 23, 2009

(87) PCT Pub. No.: WO2009/003298

PCT Pub. Date: Jan. 8, 2009

(65) Prior Publication Data

US 2010/0170548 A1 Jul. 8, 2010

(30) Foreign Application Priority Data

Jul. 3, 2007 (CH) ..... 1071/07

(51) Int. Cl.
*A45B 9/00* (2006.01)

(52) U.S. Cl.
USPC ..... 135/75; 135/85

(58) Field of Classification Search
USPC ..... 135/75, 82
See application file for complete search history.

(56) References Cited

U.S. PATENT DOCUMENTS

| | | | | |
|---|---|---|---|---|
| 2,512,985 | A | 6/1950 | Tveten et al. | |
| 7,025,072 | B2 * | 4/2006 | McGrath | 135/75 |
| 7,229,101 | B2 * | 6/2007 | Lenhart | 280/819 |
| 2002/0170587 | A1 * | 11/2002 | Uemura | 135/65 |
| 2005/0207829 | A1 * | 9/2005 | Lenhart | 403/109.5 |
| 2007/0252375 | A1 | 11/2007 | Roiser | |

FOREIGN PATENT DOCUMENTS

| | | | |
|---|---|---|---|
| AT | 007 045 | U1 | 9/2004 |
| CH | 680771 | A5 | 11/1992 |
| DE | 298 13 601 | U1 | 1/2000 |
| DE | 203 18 642 | U1 | 4/2004 |
| EP | 0 904 810 | A2 | 3/1999 |
| EP | 1 584 256 | A2 | 10/2005 |
| GB | 636739 | A | 5/1950 |

* cited by examiner

*Primary Examiner* — David Dunn
*Assistant Examiner* — Danielle Jackson
(74) *Attorney, Agent, or Firm* — Sughrue Mion, PLLC

(57) ABSTRACT

The present invention relates to a stick (23), such as, for example, a trekking, downhill skiing, hiking or Nordic walking stick, which has a stick handle (28), a stick tube (24) comprising at least three telescopic tubular sections (25, 26, 27), and a stick point (29). Two adjacent tubular sections can each be adjusted relative to each other. The stick (23) according to the invention has a damping device (1) with a compression spring device (35), wherein an axial pin (2) which is secured axially on a second tubular section (26) is guided in a guide sleeve (10) held in a rotationally fixed manner in a first tubular section (25).

18 Claims, 6 Drawing Sheets

STICK WITH A SHOCK ABSORBER

TECHNICAL FIELD

The present invention relates to a pole, for example a trekking, ski, hiking or Nordic walking pole, which has a pole grip, a pole shaft made of at least three telescopic tube portions and a pole tip. In each case two adjacent tube portions can be adjusted relative to one another. The pole according to the invention has a damping device with a guide sleeve which is retained in a rotationally fixed manner in a first tube portion and in which an axial pin secured axially in a second tube portion is guided.

PRIOR ART

The prior art discloses various poles with impact dampers, for example those in DE-U-298 13 601 and CH 680 771 A5, although these two allow only relatively hard impact damping. EP 1 435 805 B1 discloses a pole with damping, of which the impact properties are less hard, thanks to a special series arrangement of the compression-spring device, and the spring-back properties are less abrupt, and have more freedom from recoil, in relation to the first two documents mentioned.

DESCRIPTION OF THE INVENTION

Accordingly, it is an object of the invention to provide a pole of straightforward design which has a damping device and has the smallest possible weight and packing dimensions and the best possible swing performance, wherein the damping device should be accommodated in as space-saving a manner as possible.

This object is achieved, inter alia, by the provision of a pole, for example a trekking, ski, hiking or Nordic walking pole, which has a hand grip, pole shaft and pole tip and at least three telescopic tube portions. In each case two adjacent tube portions here can be adjusted relative to one another. The pole according to the invention has a damping device or an impact damper with a guide sleeve retained in a rotationally fixed manner in a first tube portion and with a compression-spring device, wherein an axial pin secured axially on a second tube portion is guided in the guide sleeve. The first tube portion here is the lowermost tube portion, and the second tube portion is the second-from-the-bottom tube portion, of the pole shaft.

The core of the invention thus consists in shifting the compression-spring device, which otherwise in poles with three tube portions is arranged in each case in the central tube portion or between the two top tube portions, into the bottom tube portion or between the two bottom tube portions. The lowermost tube portion of the three telescopic tube portions here has the smallest diameter and is at the same time, in the telescoped state or in the case of the smallest packing dimensions, the innermost tube portion. The diameter of the uppermost tube portion is greater than the diameter of the central or second-from-the-bottom tube portion, and the latter diameter, in turn, is greater than the diameter of the lowermost tube portion. For example, in the case of poles with four tube portions, preferably at least one compression-spring device is arranged in the lowermost of the four tube portions, wherein the lowermost tube portion, at the same time, is the innermost of the four tube portions.

As an alternative, and in general terms, in a pole design (e.g. with three telescopic portions) in which the uppermost tube has the smallest diameter, the compression-spring device, as described here, may be arranged in the uppermost tube portion with a clamping device directed downwards; this also gives rise to an advantageous swing performance and minimal packing dimensions.

By virtue of shifting the compression-spring device into the lowermost tube portion, the weight and also the overall size of the pole are reduced since less tube material is necessary. At the same time, the center of gravity of the pole is thus shifted further downward, which results in improved swing performance of the pole. Moving the compression-spring device out of the central tube portion, then, makes it possible for the three tube portions to be telescoped essentially to the full extent one inside the other, in which case the pole length decreases by approximately two-thirds in its packing size.

The pole presented in EP 1 435 805 B1 does indeed give rise to an improvement in the damping properties, but the arrangement of the relatively high-outlay compression-spring device in the central pole portion means that it is no longer possible for the pole to telescope to the full extent since the damping device, in the outer tube of two tubes, is in the way of the inner tube. It should always be ensured, in the case of such a design, that the installed spring unit is taken into account in respect of the tube lengths. This affects the packing dimensions of a telescopic pole such that the bottom part or the innermost tube portion strikes against the spring unit. In the production of telescopic poles with three tube portions of different diameters, for example, it is also necessary, in the case of arranging the impact damper in the central tube portion, to meet additional costs for the production of tube portions which are not of the standard length used for poles without impact dampers.

Shifting the spring unit into the bottom part, i.e. into the bottom or inner tube portion, frees the space which was previously taken up for the installation of the spring in the central part, i.e. in the central tube portion. In the case of the compression-spring device being arranged according to the invention in the bottom and inner of two tube portions, the interior of this tube portion can be utilized as desired since there is not usually any length-adjusting mechanism arranged there. In addition, the shifting according to the invention means that the pole has a smaller weight, since a few centimeters of tube which had to be used previously for the installation space in the central tube portion are done away with. In particular it is possible for the compression-spring device, by virtue of being installed in the lowermost tube portion, to be more intricate and/or to have a smaller diameter, since less material is necessary in order to fill the lowermost or innermost telescopic tube portion, which thus also has the smallest tube diameter. This is also accompanied by a reduction in weight of the compression-spring device installed. Moreover, the design according to the invention makes it possible to use the same tube lengths for poles with impact dampers as for poles without impact dampers, wherein the additional costs of producing special lengths, these additional costs having to be met when the compression-spring device is arranged in the central tube portion, since a longer tube portion is necessary there, are done away with. It is also possible, then, for all three telescopic tube portions of a pole shaft to be of the same length.

In the case of the abovementioned embodiment of the invention, the lowermost tube portion has a central axial cavity or a blind hole in which the guide sleeve is incorporated.

According to a first preferred embodiment, the lowermost tube portion has a smaller diameter than the second-from-the-bottom tube portion, wherein preferably, in addition, the second-from-the-bottom tube portion has a smaller diameter than the third-from-the-bottom tube portion adjacent to it.

According to a further preferred embodiment, the entire compression-spring device is mounted or arranged in the guide sleeve. The guide sleeve preferably at least has a bottom region and a central region mounted in the lowermost tube portion. It is advantageous here if the guide sleeve has a proportion of approximately 60-90%, preferably has approximately 80%, of its length mounted in the lowermost tube portion.

According to a further preferred embodiment of the invention, the compression-spring device has at least one helical compression spring and/or at least one elastomer spring. Various series or parallel arrangements of helical compression springs and elastomer springs are possible here. Particularly good damping behavior is achieved if the compression-spring device has, in a series arrangement, a helical compression spring and an elastomer spring at each of the two axial ends thereof. It is conceivable for the compression-spring device to be disconnectable or for the spring arrangement to be prestressed. It is additionally possible for the compression-spring device to have springs with different spring characteristics, for example on account of different levels of hardness or different spring constants. In respect of the properties of the compression-spring arrangement, the subject matter of EP 1 435 805 B1 is included explicitly in the disclosure content of the present document. The spring travel, in the pole according to the invention, is essentially 5-15 mm, preferably 7-12 mm, in particular preferably 8-10 mm. Different spring characteristics of helical compression springs and elastomer springs mean that it is possible to achieve, for example, non-linear damping. The same applies to the expansion, i.e. the spring-back behavior.

The pole shaft preferably has two, three or four, in particular preferably three, tube portions which can be telescoped one inside the other. According to a further preferred embodiment, the lowermost tube portion of the pole according to the invention has a diameter of 10-14 mm, preferably 12 mm. The second-from-the-bottom tube portion advantageously has a diameter of 12-16 mm, preferably 14 mm, and the third-from-the-bottom tube portion has a diameter of 14-18 mm, preferably 16 mm. According to a further preferred embodiment, the design according to the invention makes it possible for all the tube portions to be of equal length.

Above the guide sleeve, a central piece may be arranged on the axial pin coaxially in relation to the compression-spring device. This central piece, which preferably consists of plastic or metal, can be pressed, screwed or injection molded, for example, onto the axial pin. It may serve simultaneously as a stop for an adjusting mechanism, which may possibly be arranged above the compression-spring device, and as a blocking-prevention means. However, it may also perform the task, for example, of a spacer or stop for tube portions.

As an alternative, or in addition, to the central piece, it is possible, above the guide sleeve, for an additional damping element, preferably an elastic ring, in particular preferably a rubber ring or an O-ring made of elastic material, to be arranged on the axial pin coaxially in relation to the compression-spring device. If a central piece is present, then the additional damping element is preferably arranged beneath the central piece and adjacent to the same. Although the elastic ring is not absolutely necessary for the function of the spring system, this additional damping element has the purpose of damping the end position of the pole with noise-reducing action. Without such a damping element, troublesome noise could arise in the compressed position of the pole when the for example metal parts in the transition region between two tube portions strike against one another, for example when the insert piece on the lowermost tube strikes against the central piece.

The guide sleeve, between a top region and a bottom region, preferably has a stop, preferably an encircling shoulder, against which the lowermost tube portion butts by way of its top edge. It is conceivable for the top, central and bottom regions of the guide sleeve each to make up essentially a third of the length of the guide sleeve, although it is preferred if the top region, which preferably projects out of the lowermost tube, is smaller than the central region and the bottom region. The top region, on its bottom edge, has preferably an encircling shoulder, against which the lowermost tube portion can butt by way of its top edge. It is possible for this shoulder either to be integrally formed or to be fastened on the top region of the guide sleeve.

According to a further preferred embodiment of the invention, the guide sleeve, preferably in its central region, has at least one axial slot, but preferably two mutually opposite slots. A transverse pin here is arranged perpendicularly to the pole axis in the guide sleeve, preferably above the compression-spring device and at least in part in the slot, in which case it can be moved axially in the slot between a top stop and a bottom stop. In addition, it is possible and preferable for the transverse pin to project through the bottom end of the axial pin.

At least one spreading device is arranged on the axial pin, coaxially with the compression-spring device and preferably above the compression-spring device. In respect of the spreading device, the subject matter of EP 1 450 906 B1 is included explicitly in the disclosure content of the present document. According to a further preferred embodiment, the lowermost tube portion, which has the damping device, can be clamped axially in the second-from-the-bottom tube portion by way of the spreading device. The spreading device here has a spreading element, which can be forced apart radially and is provided with an inner cone, and an inner element, which is provided with an outer cone running in the opposite direction and is accommodated such that it can be displaced axially in the spreading element, and an axially directed adjusting screw, which is retained in a rotationally fixed manner on the lowermost tube portion and is operatively connected to an internally threaded bore in the inner element. The inner cone of the spreading element preferably runs such that it opens in the direction of the lowermost tube portion, and that the spreading element is retained such that it can be moved axially, preferably within narrow limits, between a bottom stop on an inner tube, preferably on the guide sleeve, in particular preferably on an insert piece anchored in the guide sleeve at one end, or on the central piece arranged coaxially above the guide sleeve, and a top stop at the free end of the adjusting screw.

According to a further preferred embodiment according to the invention, the inner cone is formed in two parts. It is also possible, however, for it to be formed in one part and to have an axial slot, which is open at the top and bottom, passing through it. As a result, for example if there are signs of wear, the inner cone can be exchanged since it is possible for it not just to be positioned axially on the axial pin, but also, with fastening means already fastened, clamped radially on the axial pin. For this purpose, the inner cone may have, for example, a film hinge or some other connecting means for the two cone halves. In the presence of a spreading device, the central piece or the additional elastic damping element, or, if these two parts are not present, the top end of the insert piece or of the guide sleeve, may provide a stop for the spreading element. For the subsequent installation of the inner cone, in addition to a slotted or divided embodiment, it is also conceivable for the inner cone to be designed such that it can be swung via film hinges, in order to pass over the fixed screw head or the head of some other fastening means.

In the case of a pole according to the invention with a spreading device, it is possible for the axial pin to have a thread in a top region, preferably merely in the region on which the spreading device is installed. The head of the axial pin is preferably integrally formed. However, it may also be fastened in a releasable manner on the axial pin, for example by means of an applied stop nut or screw. This separately applied, termination-forming head of the axial pin is preferably fixed by a connecting method which can be subjected to high loading and creates the effect, retrospectively, of an integrally formed head, in order to provide an abutment shoulder, which can be subjected to loading, for the spreading element. If the head is integrally formed, i.e. if the axial pin is integral with the head, it is conceivable for the inner cone, upon assembly, to be screwed onto the axial pin from beneath before the axial pin is introduced into the guide sleeve. In the case of a separate head, it is also possible for a non-slotted or divided inner cone to be exchanged at a later stage by the head being removed and the inner cone being installed via the then free top end.

If a helical compression spring is provided, then the compression-spring device has preferably at least one stub which projects into one end of the helical compression spring and has a protrusion. It is advantageous here, in the case of a series arrangement of helical-compression and elastomer springs, if the protrusion of the stub is directly adjacent to the elastomer spring, the elastomer spring being prevented from penetrating into the helical compression spring. In such a case, to a certain extent the stub is arranged between the helical-compression and elastomer springs, wherein the two spring types are spaced apart axially, at most, by a small region of the stub protrusion.

For assembly, in the first instance the compression-spring device is inserted into the guide sleeve. This compression-spring device advantageously has positioned on it an accommodating element which is open upward preferably essentially in the form of a cup and into which the axial pin can then be inserted. Thereafter, preferably an insert piece can be positioned on the guide sleeve, this insert piece engaging, in part, axially in the guide sleeve and likewise having a central aperture for accommodating the axial pin. On its portion which projects into the guide sleeve, the insert piece advantageously has at least one nose, preferably two noses, or an encircling nose, the latter self-latching in corresponding apertures or at least one undercut in the guide sleeve. In order for it to be possible for the transverse pin to be introduced through the guide sleeve and into the slot, or preferably the two mutually opposite slots, in the lowermost tube portion, the axial pin can be subjected to force from above until the through-opening at the bottom end of the axial pin ends up located in the slot, in which case the transverse pin can be pushed in through the slot and the through-opening of the axial pin, and the second slot located opposite, which is preferably present. It may thus be the case that the compression-spring device is also prestressed slightly in the non-compressed position of the pole. At the same time, the transverse pin prevents the compression spring from being torn out upward and allows axial movement of the compression-spring device within the slot. After the transverse pin has been inserted, the guide sleeve can be inserted into the blind hole of the lowermost tube portion.

It is further possible for the axial pin to be formed in two parts, and for the two parts to be connected via a connecting part. A single-part design of the axial pin, however, is preferred, since this allows simplified construction. In such a case, the single-part axial pin has a through-passage. The axial pin preferably has a diameter of 0.3-1 cm, preferably between 0.4 and 0.7 cm.

Further preferred embodiments of the present invention are described in the dependent claims.

BRIEF EXPLANATION OF THE FIGURES

The invention will be explained in more detail hereinbelow by way of exemplary embodiments and in conjunction with the drawings, in which:

FIG. 2*b* illustrates a section through section axis B-B; FIG. 4*b* illustrates a section through section axis D-D.

WAYS OF IMPLEMENTING THE INVENTION

Exemplary embodiments will be presented hereinbelow to illustrate the abovedescribed invention. It should be emphasized here that these exemplary embodiments should be used for explaining and documenting the implementability of the invention, but not for limiting the general concept of the invention as defined in the appended claims. Modifications and variations of the exemplary embodiment as discussed hereinbelow are familiar to a person skilled in the art and are likewise covered by the claims.

Figure 1:
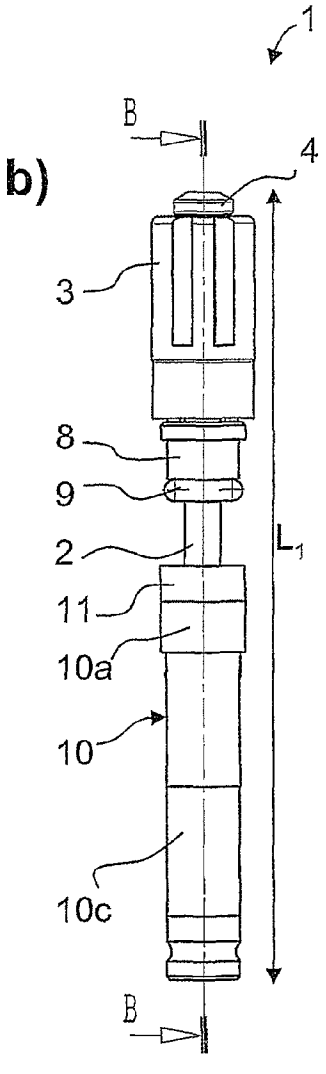
FIG. 1 shows two schematic views of a damping device according to a first preferred embodiment of the invention in the non-compressed state, wherein FIG. 1*a*) and FIG. 1*b*) show the damping device in two views rotated through 90 degrees.
Figure 1:
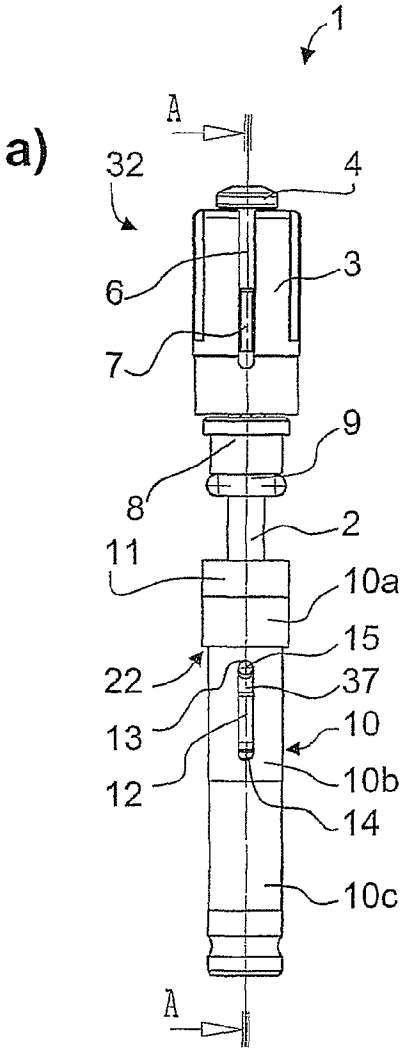

FIG. 1 illustrates two schematic views, each rotated through 90 degrees in relation to one another, of a damping device according to a first preferred exemplary embodiment of the invention in the non-compressed state. In the non-compressed state, the damping device 1 has a length L1 which corresponds to the distance from the top end of the head of the fastening means 4 to the bottom end of the guide sleeve 10. The tube portions are not illustrated in this figure. The illustrated exemplary embodiment of the damping device 1 according to the invention has a guide sleeve 10 which is mounted in a rotationally fixed manner in a blind hole or an axial central cavity 20 of the lowermost tube portion 25 of a pole shaft 24 and in which an axial pin 2 engages by way of its bottom free end. A spreading device 32 is illustrated above the guide sleeve, coaxially with the guide sleeve, and this spreading device has a spreading element 3, an inner element 33, which can be seen in the sections of FIG. 2, and an inner cone 5. The axial pin 2 is provided with an external thread at least at its top end and has a head 4 fixed axially by a fastening means, preferably a screw. The head 4 forms the top stop for the spreading element 3. The bottom stop of the spreading element 3 is formed, in FIG. 1*a*, by a central piece 8 which, for example, is integrally formed on the axial pin 2 or screwed, positioned, clamped or welded thereon. An additional elastic damping element 9, in this case in the form of an elastic O-ring, is arranged beneath the central piece 8 in FIG. 1, and this damping element serves for damping noise in the end position of the damped pole 23. In the undamped state of the pole 23, the state illustrated in FIGS. 1*a* and 1*b*, a portion of the axial pin 2 is exposed beneath the spreading element or the central piece 8 and elastic ring 9. Following this in the downward direction, the compression-spring device 35 is arranged in the guide sleeve 10.

Figure 2:
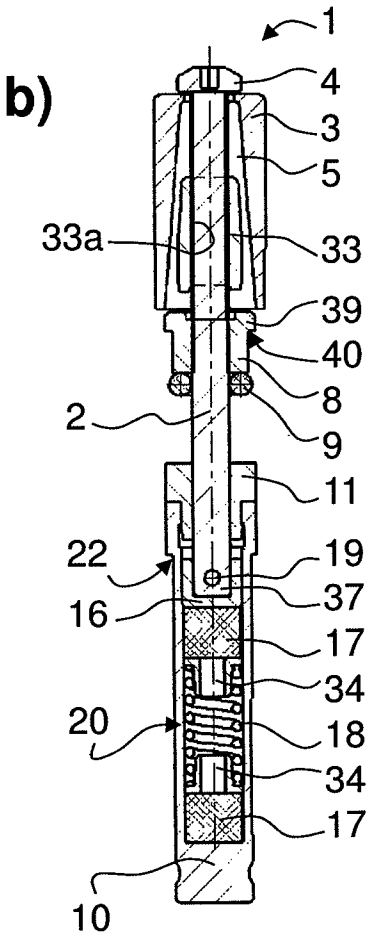
FIG. 2 shows two axial sections through the damping device from FIG. 1, wherein FIG. 2*a*) illustrates a section through section axis A-A
Figure 2:
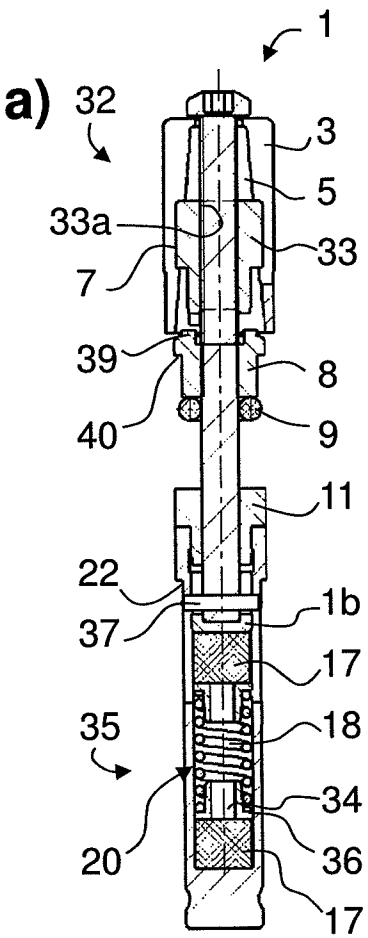

The spreading element 3 has at least one axial aperture 6, but preferably two mutually opposite axial apertures 6. The inner element 33, which is arranged coaxially within the spreading element 3, engages in this aperture 6 by way of at least one axial rib 7, but preferably by way of two ribs 7 located opposite one another on the inner element 33. This aperture 6 is not visible in FIG. 1*b* since the damping device has been rotated through 90 degrees in relation to FIG. 1*a* and, in the exemplary embodiment illustrated, there is no other aperture located in the spreading element 3 at a position rotated through 90 degrees from the aperture 6. In the illustrations of FIGS. 1 and 2, the spreading device is in the non-spread state.

FIG. 1*a* shows the slot 12, which is arranged in the central region 10*b* of the guide sleeve 10, essentially U-shaped in section, and forms a top stop 13 and a bottom stop 14. A transverse pin 15, which passes through the axial pin 2 at its bottom end, is arranged between these stops 13, 14 such that it engages in the guide sleeve and, at least in part, radially in the slot 12. In the illustrations of FIGS. 1 and 2, i.e. with the pole 23 in the non-compressed or undamped state, the transverse pin 15 is located at the top stop 13 of the slot 12 of the guide sleeve 10. An insert piece 11 is positioned or fastened on the guide sleeve 10 or the top region 10*a* thereof. By way of a region which, at its bottom end, bears at least one nose 37, preferably an encircling nose 37, which serves for self-latching in an undercut of the guide sleeve on the radial inner side thereof, this insert piece engages in the guide sleeve 10 or the top region 10*a* thereof, which can be seen in the section of FIG. 2. The axial pin 2 has its bottom end 38 accommodated in an accommodating element 16, which is of essentially cup-like form and is mounted in the guide sleeve 10. The accommodating element 16 thus forms an intermediate element between the compression-spring device 35 and the axial pin 2. The transverse pin 15, which is illustrated perpendicularly to the pole axis S in FIG. 2*a*, projects, as seen from the outside inward, in the first instance through the wall of the guide sleeve 10, then through the axial pin 2 and then through the opposite wall of the guide sleeve 10.

FIGS. 1-5 do not illustrate any tube portions 25, 26, 27 of the pole shaft. It is preferred, however, if the guide sleeve 10 is mounted in a rotationally fixed manner up to its abutment shoulder 22 in the lowermost tube portion. The abutment shoulder 22 thus forms the top stop for the top edge of the lowermost tube portion 25. Since compressive forces act on the compression-spring device 35, which is mounted in the lowermost tube portion 25, it is advantageous if the guide sleeve is integrally formed and thus also the abutment shoulder 22 is integrally formed in the top region 10*a* of the guide sleeve 10. It would also be conceivable, however, for just the insert piece 11 to form the top stop for the lowermost tube portion 25, although in this case the insert piece 11 should then be fastened appropriately firmly to the guide sleeve 10.

In FIGS. 2*a* and 2*b*, the compression-spring device is formed as a series arrangement of three springs, wherein an elastomer spring 17 is arranged at the two axial ends, at the top and bottom in each case, of a helical compression spring 18. The elastomer spring 17 and the helical compression spring 18 have arranged between them an essentially T-shaped stub 34 which engages, in part, in the helical compression spring 18 and thus prevents the elastomer spring 17 from penetrating into the helical compression spring 18. The disk-like region of the T-shaped stub defines the distance between the elastomer spring 17 and helical compression spring 18.

The central piece, which can be seen to particularly good effect in section in FIGS. 2*a* and 2*b*, has, preferably at its top end, an encircling nose 39 in the axial direction and an encircling protrusion 40 in the radial direction. The encircling nose 39 serves for stopping the central piece 8 on the underside of the inner cone 5. The indentation of the central piece which is produced by the nose 39 affords the spreading element a certain amount of axial play within narrow limits.

Figure 3:
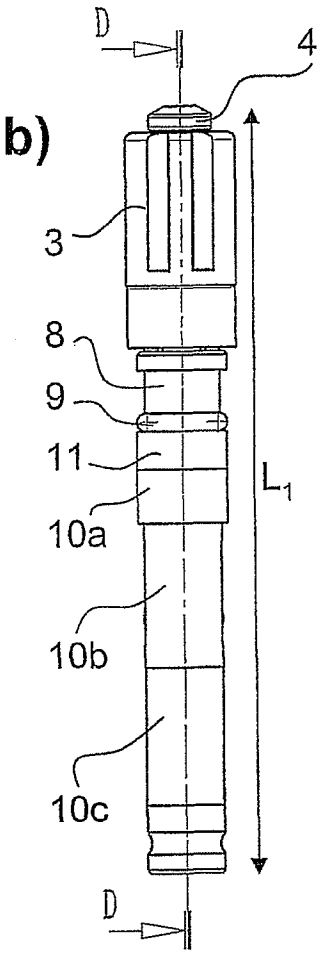
FIG. 3 shows two schematic views of a damping device according to a first preferred embodiment of the invention in the compressed state, wherein FIG. 3*a*) and FIG. 3*b*) show the damping device in two views rotated through 90 degrees in the circumferential direction.
Figure 3:
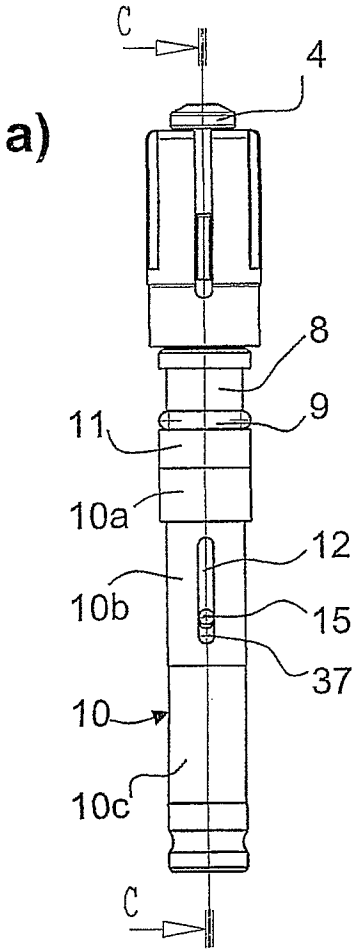
Figure 4:
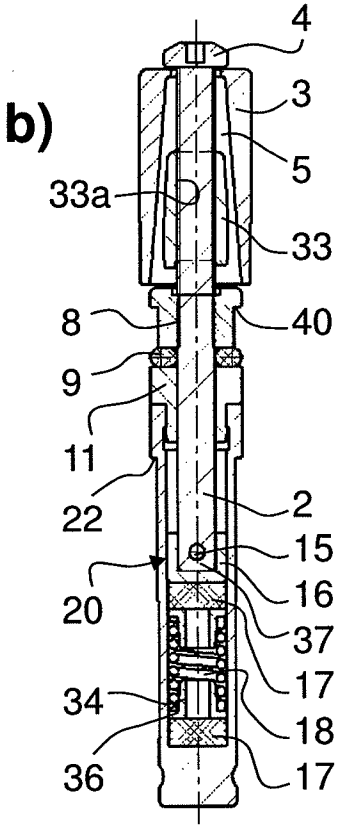
FIG. 4 shows two axial sections through the damping device from FIG. 3, wherein FIG. 4*a*) illustrates a section through section axis C-C
Figure 4:
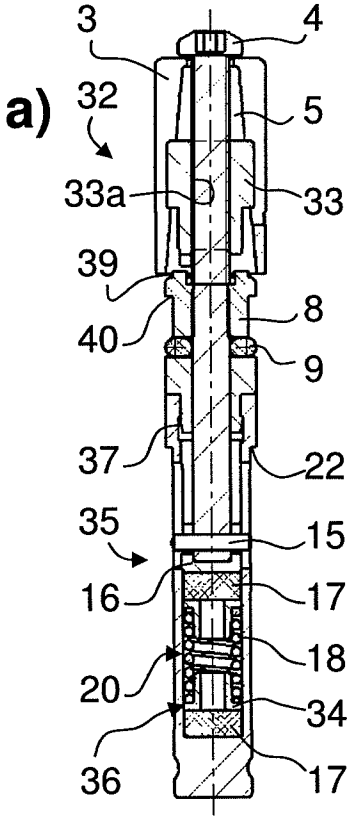

FIGS. 3 and 4 illustrate an exemplary embodiment of the damping device 1 according to the invention in the compressed position. In contrast to the illustration of FIG. 1, in this case there is no part of the axial pin exposed between the spreading element 3 and engagement piece 11. The elastic ring 9 rests on the engagement piece 11. It can also be seen that, in the compressed position, the transverse pin 15 is arranged essentially on the bottom stop 14 of the slot 12 in the guide sleeve. It is only that part of the bottom end 37 of the axial pin 2, the transverse pin 15 projecting through the latter, which is accommodated in the accommodating element 16 which prevents the transverse pin 15 from coming into direct contact with the bottom stop 14. In the compressed state, the damping device 1 has a length L1' which is smaller than the length L1 of the damping device 1 in the non-compressed state. Typically, the shortening of the length of the pole from the undamped state into the damped state is approximately 5-15 mm, preferably 7-12 mm, in particular preferably 8-10 mm.

Figure 5:
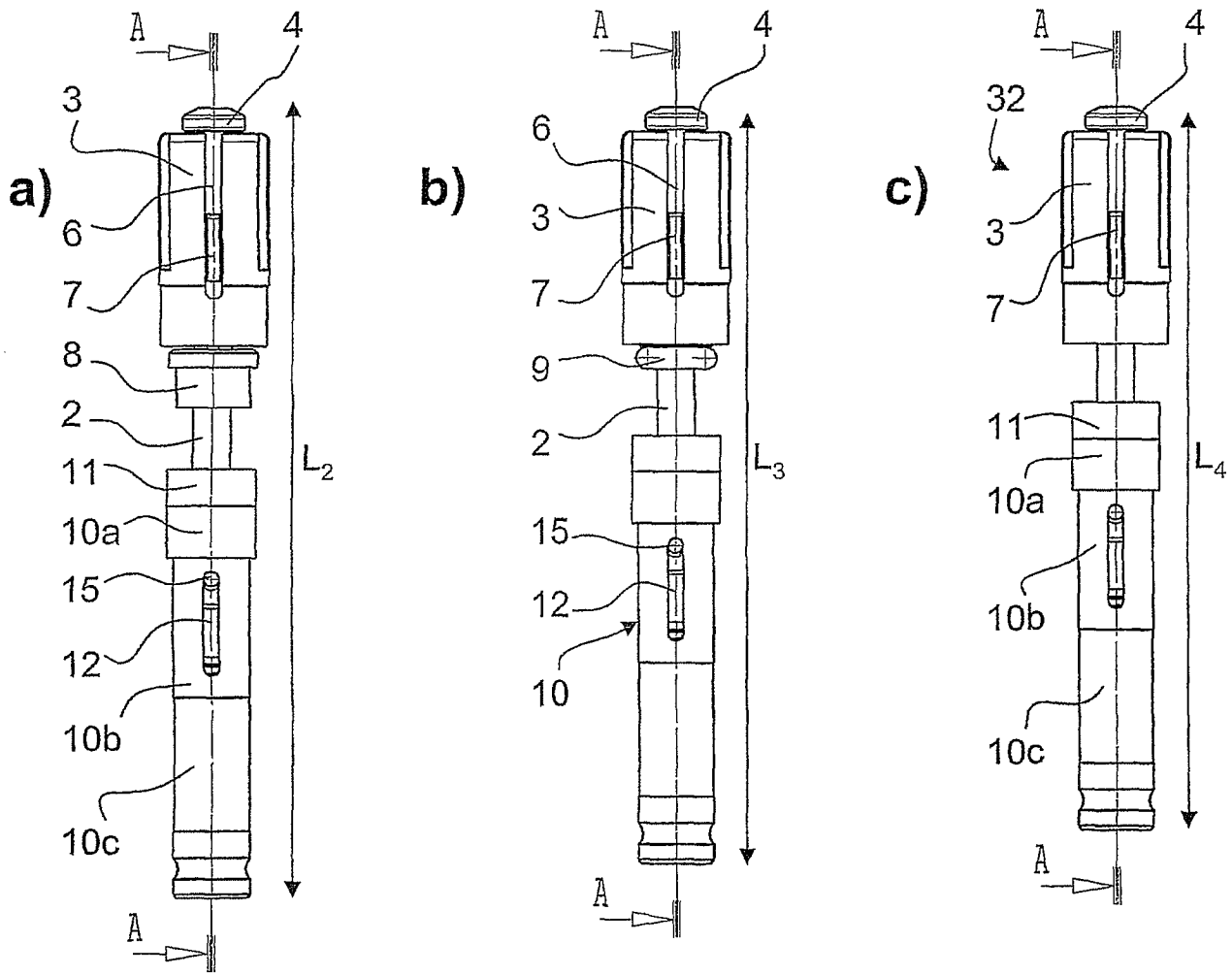
FIG. 5 shows schematic views of three alternative exemplary embodiments of a damping device according to the invention in the non-compressed state, wherein FIG. 5*a*) illustrates a damping device without a central piece, FIG. 5*b*) illustrates a damping device without a rubber ring, and FIG. 5*c*) illustrates a damping device without a central piece or a rubber ring.

FIG. 5 illustrates three alternative exemplary embodiments of damping devices 1 in the non-compressed state, wherein the damping device 1*a* illustrated in FIG. 5*a* does not have any additional damping element 9. The damping device 1*b* of FIG. 5*b* has no central piece 8, and the damping device 1*c* of FIG. 5*c* does not have either of these elements 8, 9. Accordingly, it is also the case that the length L2 of the non-compressed damping device 1*a* of FIG. 5*a* is smaller than the length L1 of the non-compressed damping device 1 of FIG. 1. The length L3 of the non-compressed damping device 1*b* of FIG. 5*b*, in turn, is smaller than the length L2 of the non-compressed damping device 1*a*, and the length L4 of the non-compressed damping device 1*c* is smaller than the length L3 of the non-compressed damping device 1*b*.

Figure 6:
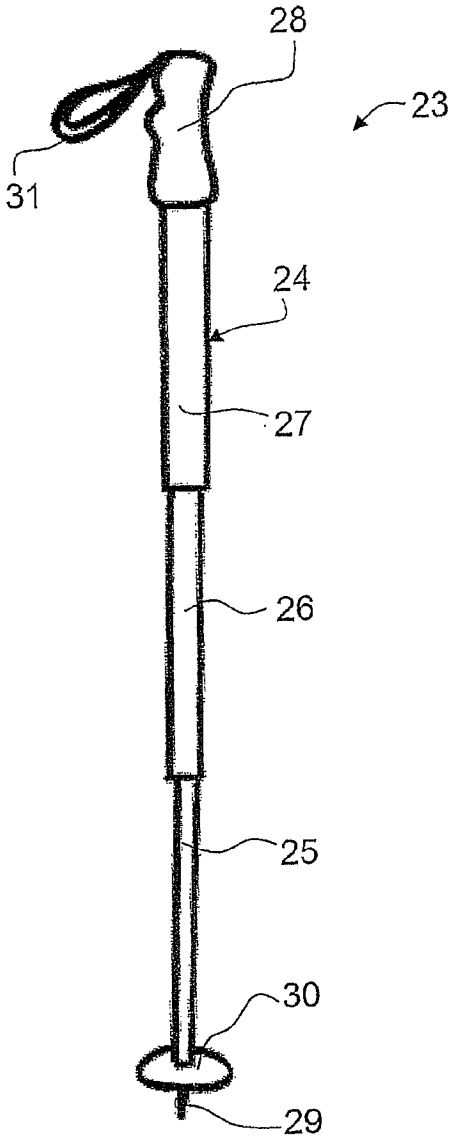
FIG. 6 shows a schematic illustration of a pole with three telescopic tube portions.

FIG. 6 illustrates a schematic view of a pole 23. The pole 23 is illustrated here, merely by way of example, as a ski pole. As has already been mentioned above, the pole 23 according to the invention may also be, for example, a trekking, hiking or Nordic walking pole or the like. According to this exemplary embodiment, the pole shaft 24 illustrated has three tube portions 25, 26, 27, wherein in each case two adjacent tube portions 25, 26 and 26, 27 can be telescoped relative to one another, and this results in the pole 23 being length-adjustable. Arranged at the bottom end of the pole 23 is a pole tip 29, which possibly has a pole basket 30 over it. In the case of a Nordic walking or hiking pole, however, it is also quite possible for the pole tip 29 to be configured as a buffer with or without spikes.

According to the illustration of FIG. 6, it is preferred if the lowermost tube portion 25 has the smallest diameter of the three illustrated tube portions 25, 26, 27 which form the pole shaft 24. It is also possible for the pole shaft 24 to comprise more than three tube portions. The diameter of the uppermost tube portion 27, which is arranged immediately beneath the pole grip 28, is preferably the tube portion with the greatest diameter. It is also conceivable, however, for the second-from-the-bottom tube portion 26 to have a greater diameter than the uppermost tube portion 27. This is conceivable, for example, in order to achieve an improved swing performance of the pole 23. For the smallest possible packing dimensions with the poles telescoped, however, it is advantageous if the tube portions have diameters which decrease as seen from top to bottom. It is also possible for each tube portion 25, 26, 27 to have differing diameters along its extent. Typically, the bottom region of a tube portion has a smaller diameter than the top region of the same tube portion. The pole grip 28 may have, if appropriate, a hand strap 31 fastened thereon or a coupling mechanism for a fastenable hand strap 31. Pole shafts 24 normally have a collar enclosing them at the transition regions between two tube portions 25, 26 and 26, 27. According to the invention, in the case of such a pole, the damping device 1 is arranged between the tube portions designated 25 and 26, i.e. the guide sleeve 10 is incorporated at the top end of the lowermost tube portion 25.

LIST OF DESIGNATIONS

1 Damping device, impact damper
1*a* Damping device without 9
1*b* Damping device without 8
1*c* Damping device without 8 or 9
2 Axial pin
3 Spreading element
4 Head of 2
5 Inner cone
6 Axial aperture of 3
7 Axial rib of 5
8 Central piece
9 Additional damping element, rubber ring
10 Guide sleeve
10*a* Top region of 10
10*b* Central region of 10
10*c* Bottom region of 10
11 Insert piece
12 Axial slot of 10
13 First stop of 12
14 Second stop of 12
15 Transverse pin
16 Accommodating element for 2
17 Elastomer spring
18 Helical compression spring
19 Opening in 2
20 Axial cavity, blind hole in 10
21 Axial aperture, groove
22 Stop, abutment shoulder in 10*a*
23 Pole
24 Pole shaft
25 Lowermost tube portion
26 Second-from-the-bottom or central tube portion
27 Third-from-the-bottom or uppermost tube portion
28 Pole grip
29 Pole tip
30 Pole basket
31 Hand strap
32 Spreading device
33 Inner element
33 a internally threaded bore of 33
34 Stub
35 Compression-spring device
36 Protrusion of 34
37 Nose of 11
38 Bottom end of 2
39 Encircling nose of 8
40 Encircling protrusion of 8
L1 Non-compressed length of 1
L1' Compressed length of 1
L2 Non-compressed length of 1*a*
L3 Non-compressed length of 1*b*
L4 Non-compressed length of 1*c*
S Pole axis

The invention claimed is:

1. A pole of the type used for trekking, skiing, hiking or Nordic walking, comprising:

at least three telescopic tube portions of a pole shaft provided with a pole grip and pole tip, wherein in each case two adjacent tube portions can be adjusted relative to one another, a damping device with a guide sleeve retained in a rotationally fixed manner in a first tube portion and with a compression-spring device, an axial pin secured axially in a second tube portion and being guided in the guide sleeve, wherein the first tube portion is the lowermost tube portion and the second tube portion is the second-from-the-bottom tube portion, wherein the guide sleeve, has a stop, against which the lowermost tube portion butts by way of its top edge, and wherein the guide sleeve, in a central region, has two mutually opposite slots, wherein a transverse pin is arranged perpendicularly to the pole axis in the guide sleeve, above the compression-spring device and at least in part in the slot, in which case the pin can be moved axially in the slot between a top stop and a bottom stop, wherein the entire compression-spring device is mounted in the guide sleeve, and wherein an insert piece is positioned on the guide sleeve, engaging in part axially in the guide sleeve and likewise having a central aperture for accommodating the axial pin.

2. The pole as claimed in claim 1, wherein the lowermost tube portion has a smaller diameter than the second-from-the-bottom tube portion.

3. The pole as claimed in claim 1, wherein the guide sleeve at least has a bottom region and a central region mounted in the lowermost tube portion.

4. The pole as claimed in claim 1, wherein the compression-spring device has at least one helical compression spring and/or at least one elastomer spring.

5. The pole as claimed in claim 4, wherein the compression-spring device h has at least one stub which projects into one end of the helical compression spring and has a protrusion.

6. The pole as claimed in claim 1, wherein the compression-spring device has, in a series arrangement, a helical compression spring and an elastomer spring at each of two axial ends thereof.

7. The pole as claimed in claim 1, wherein the pole shaft has three or four tube portions.

8. The pole as claimed in claim 1, wherein a central piece is arranged on the axial pin coaxially above the guide sleeve.

9. The pole as claimed in claim 1, wherein, above the guide sleeve, an additional damping element is arranged on the axial pin coaxially in relation to the compression-spring device.

10. The pole as claimed in claim 1, wherein the transverse pin projects through the bottom end of the axial pin.

11. The pole as claimed in claim 1, wherein the lowermost tube portion has a diameter of 10-14 mm, wherein the second-from-the-bottom tube portion has a diameter of 12-16 mm, and wherein the third-from-the-bottom tube portion has a diameter of 14-18 mm.

12. The pole as claimed in claim 1, wherein at least one spreading device is arranged on the axial pin, coaxially with the compression-spring device and above the compression-spring device.

13. The pole as claimed in claim 12, wherein the lowermost tube portion, which has the damping device, can be clamped axially in the second-from-the-bottom tube portion by way of the spreading device, and wherein the spreading device has a spreading element, which can be forced apart radially and is provided with an inner cone, and an inner element, which is provided with an outer cone running in the opposite direction and is accommodated such that said inner element can be displaced axially in the spreading element, and an axially directed adjusting screw, which is retained in a rotationally fixed manner on the lowermost tube portion and is operatively connected to an internally threaded bore in the inner element, wherein the inner cone of the spreading element runs such that said cone opens in the direction of the lowermost tube portion, and that the spreading element is retained such that the spreading element can be moved axially, within narrow limits, between a bottom stop on the insert piece anchored in the guide sleeve at one end, and a top stop at the free end of the adjusting screw.

14. The pole as claimed in claim 13, wherein the inner cone is formed in at least one part and has at least one axial slot, which is open at the top and bottom, passing through said inner cone.

15. The pole as claimed in claim 13, wherein the inner cone is formed in at least one part and has at least one axial slot, which is open at the top and bottom, passing through said inner cone.

16. The pole as claimed in claim 1, wherein the lowermost tube portion has a smaller diameter than the second-from-the-bottom tube portion, wherein the second-from-the-bottom tube portion has a smaller diameter than the third-from-the-bottom tube portion adjacent to the second-from-the-bottom tube portion.

17. The pole as claimed in claim 1, wherein, above the guide sleeve, an additional damping element, an elastic ring, is arranged on the axial pin coaxially in relation to the compression-spring device.

18. The pole as claimed in claim 1, wherein the guide sleeve, between a top region and a bottom region, has a stop, in the form of an encircling shoulder, against which the lowermost tube portion butts by way of a top edge of said tube portion.

* * * * *